US005134727A

United States Patent [19]

Scott

[11] Patent Number: 5,134,727

[45] Date of Patent: Aug. 4, 1992

[54] SANITARY DRAIN ADAPTOR

[76] Inventor: William A. Scott, 1410 N. 7th Ave. East, Duluth, Minn. 55805

[21] Appl. No.: 552,484

[22] Filed: Jul. 16, 1990

[51] Int. Cl.[5] ..... E03D 11/16

[52] U.S. Cl. ..... 4/252; 285/58

[58] Field of Search ..... 4/252 R, 661; 285/56-60

[56] References Cited

U.S. PATENT DOCUMENTS

| | | | |
|---|---|---|---|
| 1,389,608 | 9/1921 | Trueman | 285/58 X |
| 1,561,436 | 11/1925 | Smith | 285/58 X |
| 2,673,985 | 4/1954 | Gay | 4/252 R |
| 4,402,093 | 9/1983 | Luker et al. | 4/661 X |
| 4,637,079 | 1/1987 | Hodge | 4/252 R X |
| 4,641,392 | 2/1987 | Huisma | 4/661 X |
| 4,766,637 | 8/1988 | Winnicki | 4/661 X |
| 4,794,653 | 1/1989 | Strasser | 4/252 R |

*Primary Examiner*—Charles E. Phillips
*Attorney, Agent, or Firm*—Douglas L. Tshida

[57] ABSTRACT

A hollowed platform mountable between a toilet stool and floor and permitting one or more above-grade waste plumbing connections. Each take-off port is recessed from a primary flow channel and a vacuum break groove interconnects each port with the other.

7 Claims, 3 Drawing Sheets

FIGURE 1
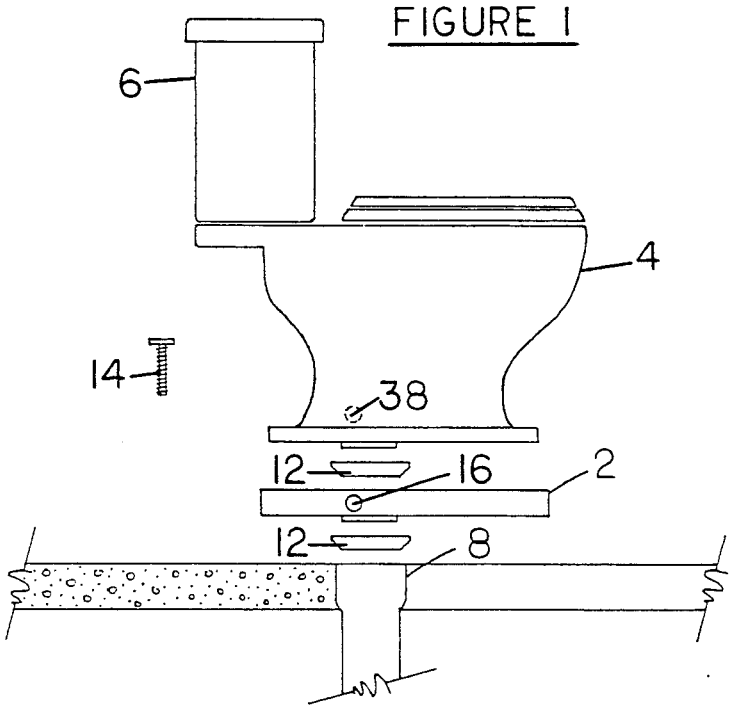
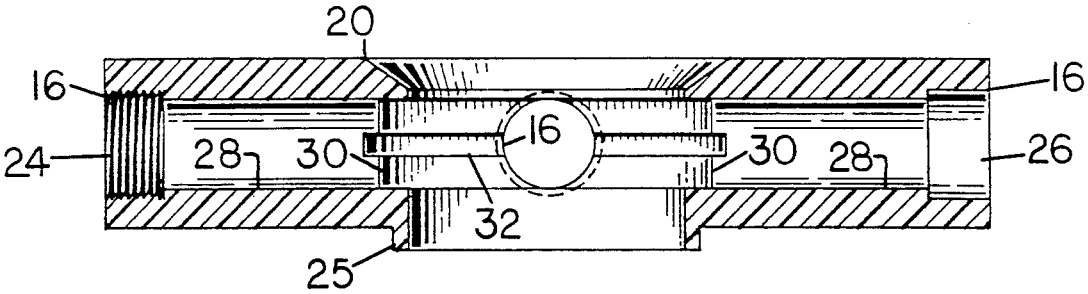
FIGURE 3

SANITARY DRAIN ADAPTOR

BACKGROUND OF THE INVENTION

The present invention relates to a waste plumbing adaptor and, in particular, to an above-grade hollow platform which couples between a toilet bowl and a primary waste drain.

A problem encountered by many home remodelers when desiring to install a shower or sink, such as during an improvement project for a partial bathroom, is that of making a suitable connection to the waste plumbing system of the building without a rather costly and time consuming effort to cut-through a poured concrete floor or partitioned wall. That is, in order to make such a connection it more times than not is necessary to cut into the finished partition walls to locate and connect to the vented waste lines. Alternatively it is necessary to access the waste system through the floor. Either effort significantly increases the complexity and time, not only to make the initial connection, but also for repairing the exposed wall/floor.

Other than the mentioned conventional practice of making a direct coupling to the waste/vent system, applicant is aware of a below-grade bowl flange which includes a plurality of additional take-off ports that radiate from the immediately adjacent sidewalls to the primary bore. However, access to such ports still requires excavating into the floor. A further disadvantage of the assembly is that, since the take-off ports radiate directly from the internal primary flow channel, under certain circumstances a siphoning of the liquid within the stool trap can occur, thereby allowing waste system gases to vent through the bowl and into the finished room space.

Appreciating the shortcomings of the foregoing assembly and the general unavailability of any intermediate device, Applicant has developed an assembly which is mountable above the finished floor and which is adapted to support a toilet bowl. Associated waste runs can thereby be readily effected above-grade.

SUMMARY OF THE INVENTION

It is accordingly a primary object of the present invention to provide an above-grade adaptor which is readily mountable to a vented toilet stool flange and whereto further waste runs may be coupled.

It is a further object of the invention to provide an adaptor which is mountable to the bowl flange without conversion.

It is a further object of the invention to provide an adaptor which supports the entire periphery of the toilet stool, which in various constructions can also exhibit the same peripheral shape.

It is a further object to provide an adaptor which prevents siphoning of trap liquid from the stool.

Various of the foregoing, objects and advantages of the invention will become more apparent upon directing attention to the following description of various presently preferred constructions, relative to the appended drawings. Before referring thereto, it is to appreciated the description should not be strictly construed in limitation of the invention. Rather, the invention should be interpreted within the scope of the following claims. To the extent modifications and/or improvements have been considered, they are described as appropriate.

BRIEF DESCRIPTION OF THE DRAWINGS

FIG. 1 shows an exploded assembly drawing of the typical mounting relation of the present adaptor to a toilet stool and floor mounted flange;

FIG. 3 shows a cross section view taken along section lines 3—3 of FIG. 2.

DESCRIPTION OF THE PREFERRED EMBODIMENT

Figure 2:
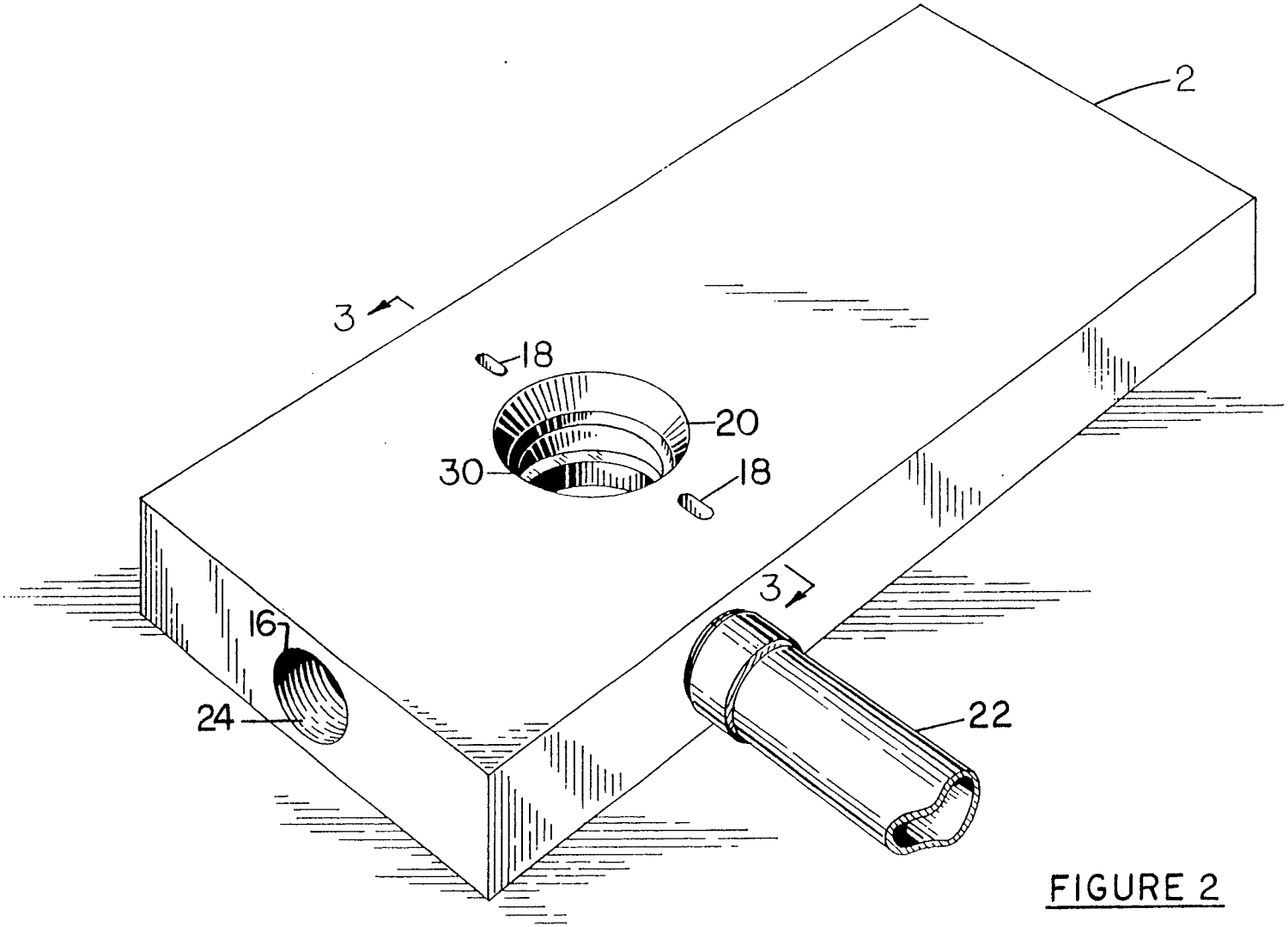
FIG. 2 shows an isometric assembly drawing of the adaptor and a typical connection thereto.

Referring to FIG. 1, an elevation view is shown in exploded assembly of the present adaptor 2 in its typical mounting relation to a toilet stool 4 and water closet 6. In a conventional mounting situation, the toilet stool 4 is bolted to a floor flange 8 that is secured to conduit 10 of the building's waste system. An annular wax seal 12 seals the joint between the stool 4 and flange 8 to prevent the escape of waste system gases, which otherwise normally exhaust to the atmosphere at a roof exhaust port (not shown). Water trapped within an "S" bend (not shown) within the stool 4 seals against gas leakage through the stool.

The flange 8 is typically set within the floor and beneath the grade surface. As depicted, the grade surface may constitute either a concrete floor or a framed floor. Otherwise, the associated waste conduits 10 are positioned below grade and/or behind finished walls. Accordingly access to the waste conduits 10 requires selective demolition and repair when adding a plumbing fixture which requires a waste connection.

Judicious use of the present adaptor 2, in contrast, provides a surface mount connection to the flange 8 which merely requires the detachment of the toilet stool 4 from the floor flange 8; the mounting of an additional seal 12 intermediate the adaptor 2 and the stool 4 and the resecuring of the adaptor 2 to the flange 8 via extended length flange bolts 14. Once installed, additional conduits for a shower or sink can be coupled to the take-off ports 16 of the adaptor in conventional fashion, albeit, above grade.

Figure 4:
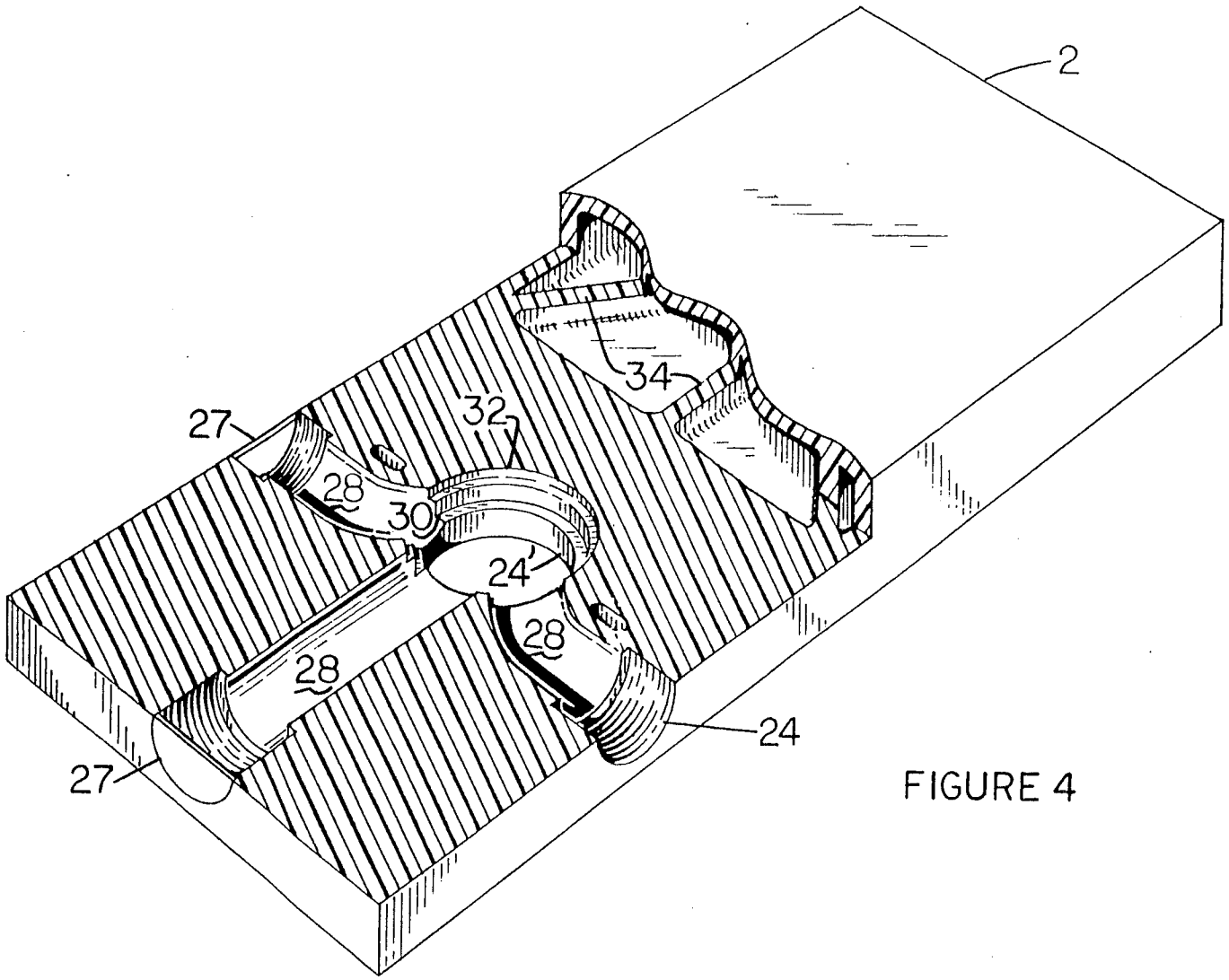
FIG. 4 shows an isometric view in partial cut away taken along reference lines 4—4 of FIG. 2.

Turning attention to FIGS. 2 through 4, additional detailed views are shown of the physical construction of the adaptor 2. With reference to FIG. 2, it is to be noted that the adaptor 2 is formed to a rectangular construction and the length and width of which have been sized to accommodate the vast variety of available toilet stools 4. The relative thickness of the adaptor is dependent upon the inside diameter of the associated waste lines 22 which are to be connected to the provided ports 16. Through holes 18 accommodate the flange bolts 14.

Appreciating that most floor flanges 8 couple to three inch waste conduits 10, the primary bore 20 must be similarly sized and the ports 16 may comprise openings of one and a half inch or two inch inside diameters. The ports 16 may all be of the same or mixed sizes. They may also accommodate a threaded connection 24 or an adhesively bonded slip connection 26 (reference FIG. 3). Their positioning and numbers are principally limited by the diameter of the primary bore 20. Normally the ports 16 are positioned such that the take-off conduits 22 which couple thereto radiate from the rear or sides of the adaptor. This is to facilitate the later framing over of these conduits with suitable covers that blend into the room floor and wall treatments. Otherwise, knock-outs or removeable covers 27 cover each port that is not being used.

Depending upon the relative run length of the take-off conduits 22 and applicable plumbing code requirements, up to three additional runs can normally be accommodated from a single adaptor 2. Such waste runs can be used to connect to a shower stall and/or sink being added as part of a remodeling project.

With attention to FIG. 3, the primary through bore 20 provides a nominal three inch inside diameter bore 24' which terminates in a lower flange projection 25. Channelways 28 extend from each of the external ports 16 and terminate at the primary bore 20 but are recessed from the primary bore walls 24' via an annular groove or channeled depression 30 to prevent against a siphoning action which will be described in greater detail below. A further annular grove or channel 32, connecting with each of the internal terminations of each channelway 28; further minimizes the potential of siphoning.

Except in the area of the bore 20 and for purposes of reducing weight and cost, the interior of the remainder of the adaptor 2 is either hollowed or includes various webbing members 34 which vertically span the upper and lower walls 36, 38 to accommodate the typically encountered loading. These latter web members 34 can particularly be seen in FIG. 4.

Each of the internal terminations of the channelways 28 is recessed relative to the interior sidewalls 24' of the primary bore 20 approximately one half to one inch. The annular channelway 32 is otherwise recessed an additional one half inch along the horizontal mid-line of the adaptor 2 and communicates with each of the outlet ports 16. In combination the depression 30 and channelway 32 assures that liquids exhausted from any of the channelways 28 does not create a siphoning action that could evacuate the liquid contained within the trap of the toilet stool 4 and which could result in release of waste gases by way of the stool 4 to the room environment.

Without the foregoing improvement, such a siphoning action could particularly occur if liquid were simultaneously exhausted by way of the primary bore 20 and at least one of the channelways 28, with the secondary flow artificially sustaining the primary flow. By, however, recessing each internal port of each channelway 28 and by coupling each internal port to the other by way of the channelway 32, liquid flow is made independent at each port. That is, a break or interruption in flow with respect to the primary bore 20 is assured as the volume of flow in any one channel 28 subsides.

Although the present adaptor 2 has also been depicted in relation to a rectangular, three-ported assembly, is to be appreciated that the peripheral sidewall contours of the adaptor 2 can be formed to match the contours of a specific stool 4. The number and positioning of the outlet ports 16 may also be varied as desired for any particular bowl configuration.

Although in its present form the adaptor thickness is also sized to accommodate circular internal channelways 28, such channelways 28 might be flattened to reduce the adaptor thickness. A recessed center space can thereby be provided whereat the stool 4 rests, with the ports 16 and outer periphery of the adaptor 2 extending above the base of the stool 4. An additional considered improvement is to form the stool 4 with channelways formed into the stool base and appropriate sealed, knockout covers at provided ports 16 along the outer periphery of the stool 4; later access merely requiring the selective removal of a cover 38. One such cover 38 is shown for illustration in FIG. 1.

While the present invention has been described with respect to its presently preferred and variously considered alternative embodiments, it is to be appreciated that still others may suggest themselves to those of skill in the art. Accordingly, the invention should be interpreted to include all those equivalent embodiments within the spirit and scope of the following claims.

What is claimed is:

1. A plumbing connector apparatus for a toilet bowl comprising:

a) a body member having an external top and bottom surface and at least one side surface, that body member including a primary flow bore extending from the top to the bottom surface, that bore having a first annular groove therein extending toward at least one side surface, said first annular groove having a second annular groove coextensive therewith, said second groove extending toward said at least one side surface further than said first annular groove;

b) at least one channelway extending radially from said at least one side surface and emptying to said primary flow bore via said second and first annular grooves;

c) wherein said body member is mountable between said toilet bowl and a primary waste conduit to convey waste from said bowl through said primary flow bore to said waste conduit and wherein said at least one channelway can convey liquid into said primary flow bore while said first and second annular grooves prevent a siphoning effect on a liquid seal in said toilet bowl.

2. Apparatus as set forth in claim 1 wherein said body member includes an annular flange projecting from a surface mating with said primary waste conduit.

3. Apparatus as set forth in claim 1 including removeable means for sealing said at least one channelway.

4. Apparatus as set forth in claim 3 wherein said removable means is integrally cast with the body member.

5. Apparatus as set forth in claim 1 wherein said body member is substantially hollow and includes a plurality of webbing members spanning upper, lower and walls of the body member.

6. Apparatus as set froth in claim 1 wherein said body member exhibits a peripheral sidewall contour, when viewed from above, substantially similar to that of a base of the toilet stool.

7. Apparatus as set forth in claim 1 wherein said at least one channelway is threaded to receive a mating coupler.

* * * * *